US008469498B2

(12) United States Patent
Ohashi et al.

(10) Patent No.: US 8,469,498 B2
(45) Date of Patent: Jun. 25, 2013

(54) INK TANK

(75) Inventors: Tetsuya Ohashi, Matsudo (JP); Yasuo Kotaki, Yokohama (JP); Ryoji Inoue, Kawasaki (JP); Koichi Kubo, Yokohama (JP); Masashi Ogasawara, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 12/549,878

(22) Filed: Aug. 28, 2009

(65) Prior Publication Data

US 2010/0053280 A1 Mar. 4, 2010

(30) Foreign Application Priority Data

Aug. 29, 2008 (JP) ..... 2008-221913

(51) Int. Cl.
*B41J 2/175* (2006.01)

(52) U.S. Cl.
USPC ..... 347/86; 347/85

(58) Field of Classification Search
USPC ..... 347/85, 86
See application file for complete search history.

(56) References Cited

U.S. PATENT DOCUMENTS

| | | | | |
|---|---|---|---|---|
| 5,351,073 | A | 9/1994 | Kageyama et al. | 347/87 |
| 5,425,478 | A | 6/1995 | Kotaki et al. | 222/501 |
| 6,170,939 | B1 | 1/2001 | Ujita et al. | 347/86 |
| 6,422,686 | B1 * | 7/2002 | Ishinaga et al. | 347/47 |
| 6,969,161 | B2 | 11/2005 | Kuwabara et al. | 347/85 |
| 7,258,431 | B2 * | 8/2007 | Shinada et al. | 347/86 |
| 2005/0285910 | A1 * | 12/2005 | Sekiguchi | 347/71 |

FOREIGN PATENT DOCUMENTS

| | | | |
|---|---|---|---|
| JP | 04-325261 | | 11/1992 |
| JP | 2004-216761 | | 8/2004 |
| JP | 2005-066520 | | 3/2005 |
| JP | 2007062335 | A * | 3/2007 |
| JP | 2007-230189 | | 9/2007 |
| JP | 2007230189 | A * | 9/2007 |

* cited by examiner

*Primary Examiner* — Jannelle M Lebron
(74) *Attorney, Agent, or Firm* — Fitzpatrick, Cella, Harper & Scinto

(57) ABSTRACT

An ink tank containing ink including a pigment component effectively prevents a problem that an ink having a higher concentration and including a sedimentary pigment is led out, even in a case where the ink tank is left unused on a printing apparatus for a long time. To this end, an ink leading-out port placed in an ink containing chamber, and used to supply the ink to a printing head is located higher than a lowermost portion of the ink containing chamber, and is also formed in an inclined surface inclined to a gravitational direction. Thereby, the sedimentary pigment slides the inclined surface, and thus is settled down in a position away from the ink leading-out port.

9 Claims, 12 Drawing Sheets

INK TANK

BACKGROUND OF THE INVENTION

1. Field of the Invention

The present invention relates to an ink tank used for an inkjet printing apparatus and the like.

2. Description of the Related Art

Examples of a printing apparatus using ink contained in an ink tank include an inkjet printing apparatus using an inkjet printing head capable of ejecting the ink. In addition, one of such inkjet printing apparatuses is a serial scan type apparatus having an inkjet printing head and an ink tank mounted on a carriage and configured to print an image on a printing medium while moving the carriage.

This serial scan type inkjet printing apparatus includes a carriage capable of mounting an inkjet printing head and an ink tank for supplying ink to the printing head. In printing, the apparatus causes the printing head to eject ink droplets through fine ejection openings provided in the printing head while moving the carriage relative to the printing medium. Thus, the ink droplets land on the printing medium and a desired image is printed.

Dye inks each using a dye as a colorant have been used chiefly as inks for inkjet printing heads. However, it is difficult to cause printed matters with dye inks to exhibit as high performances as those required for application such as an outdoor printed display for which light resistance and weather resistance are considered important. For this reason, instead, pigment ink using a pigment as a colorant has been put into practical use. Nevertheless, pigment particles in pigment ink inevitably are settled down in an ink tank because the pigment is not of a solution type, but of a dispersion type.

For instance, in a case where an ink tank is left unused while mounted on an inkjet printing head for a long period of time, pigment particles in the ink are gradually settled down in the ink tank. For this reason, the concentration gradient of the pigment particles occurs from the bottom portion toward the uppermost potion of the ink tank. As a result, ink in the bottom portion of the ink tank forms an excessively-dense color layer due to a higher concentration of the pigment particles, whereas ink in the uppermost portion of the ink tank forms an excessively-light color layer due to a lower concentration of the pigment particles.

Let us consider a case where an ink tank configured to lead out ink from its bottom portion is stored at a certain posture (with its bottom portion faced down in the vertical direction) for a long period of time. When ink led out of such an ink tank is supplied to a printing head, the ink in the layer with a higher concentration of pigment particles is supplied first, thereby printing an image with an excessively-dense color. In other words, a visible difference in printed density may occur between printed images formed in an early stage and a later stage of the ink tank use. This phenomenon is conspicuous particularly in a color printing operation for printing a color image by use of gradations of color.

To solve these problems, each of Japanese Patents Laid-open Nos. 2004-216761 and 2005-066520 discloses a configuration in which an agitating member (agitating body) is provided in an ink tank. In the configuration, ink is agitated in the ink tank by moving the agitating body with an inertial force occurring due to the reciprocating motion of the carriage.

Specifically, Japanese Patent Laid-open No. 2004-216761 discloses an ink tank having a swingable agitating body thereinside. The center of the swing of the agitating body is set almost in the center of the inside of the ink tank in a movement direction of the carriage. Accordingly, this agitating body swings similarly in one and the other directions in response to the reciprocating motion of the carriage. Furthermore, Japanese Patent Laid-open No. 2005-066520 discloses an ink tank having an agitating body thereinside, the agitating body being swingable with elastic deformation. This agitating body is hung from a substantially central portion of the upper inner surface of the ink tank. This agitating body also swings similarly in one and the other directions in response to the reciprocating motion of the carriage. In addition, Japanese Patent Laid-open No. 2005-066520 describes another configuration in which an ink tank has an agitating body thereinside, the agitating body being freely movable on the bottom surface of the ink tank. This agitating body freely moves on the bottom surface of the ink tank due to the reciprocating motion of the carriage.

Moreover, Japanese Patent Laid-open No. 2007-230189 discloses a configuration in which: agitating members are provided in the inside of an ink containing chamber of an ink tank, the agitating members agitating ink in the ink containing chamber; and an ink leading-out port is provided in the ink containing chamber at a position higher than its bottom portion that is situated lowermost when the ink tank is placed at a posture for use. Because the ink leading-out port is placed higher than the lowermost portion, the sedimentary ink in a lowermost layer with a higher specific gravity is prevented from entering the ink supply port of a printing head. Each agitating member is configured to have an end-side portion rotatably supported by a supporting part provided in the ink containing chamber; and a support point for the rotation linearly movable along the supporting part.

However, the ink tanks respectively described in Japanese Patents Laid-open Nos. 2004-216761 and 2005-066520 have the following problems. First, in the ink tank disclosed in Japanese Patent Laid-open No. 2004-216761, the agitating body swings similarly in one and the other directions about the substantially central portion of the inside of the ink tank. For this reason, to enhance the agitating performance of the agitating body by widening the swingable range of the agitating body, the width of the ink tank needs to be enlarged in the movement direction of the carriage. However, since multiple ink tanks are mounted on the single carriage in the movement direction of the carriage in many cases, the ink tank inevitably has to be formed with a relatively small width. Thereby, the swingable range of the agitating body cannot be widened, and the ink flow caused by the swing of the agitating body is small. To fully agitate the ink, time for agitation needs to be extended by increasing the number of times the carriage reciprocates.

On the other hand, in ink tank disclosed in Japanese Patent Laid-open No. 2005-066520 including the agitating body hung from the substantially central portion of the upper inner surface of the ink tank, the agitating body swings similarly in one and the other directions about the substantially central portion of the inside of the ink tank. To enhance the agitating performance of the agitating body by widening the swingable range of the agitating body, the width of the ink tank in the movement direction of the carriage needs to be enlarged as in the ink tank disclosed in Japanese Patent Laid-open No. 2004-216761. In this respect, the ink tank described in Japanese Patent Laid-open No. 2005-066520 has the same problem as the ink tank described in Japanese Patent Laid-open No. 2004-216761. In addition, in a case where the acceleration of the carriage is set larger to elastically deform the agitating body to a larger extent, a larger and more expensive driving source (a motor or the like) may be needed for the carriage, and the printing apparatus may cause larger vibrations. In the ink tank disclosed in Japanese Patent Laid-open No. 2005-066520 including the agitating body freely movable on the bottom surface of the ink tank, the agitating body has a problem of having a poor capability of agitating an upper portion of the ink in the ink tank because the agitating body is away from the upper portion of the ink.

These problems with the ink tanks disclosed in Japanese Patents Laid-open Nos. 2004-216761 and 2005-066520 are also clear from a viewpoint of configurations of a generally-used ink tank and printing apparatus.

In general, a width and length of ink tanks mounted on a carriage are set to enhance the usability in attaching and detaching the ink tank. Specifically, the width of the ink tank in the movement direction of the carriage is set relatively small, and the length of the ink tank in a conveyance direction of a printing medium which crosses over the movement direction of the carriage is set relatively large. For this reason, it is difficult to set the agitating body to be largely displaceable in its displacement direction that is in parallel with the movement direction of the carriage. As a result, the amount of displacement of the agitating body is so small that strong flow of the ink cannot be caused. This limits the agitating body's agitating efficiency of the ink, and requires too much time to fully agitate the ink in the ink tank. For instance, in a case where pigment particles contained in the ink in the ink tank are settled down because the printing apparatus has carried out no printing operation for a long period of time with the ink tank being mounted on the carriage, the carriage has to be reciprocated for a long time before starting a printing. This increases 'warm-up' time before the printing apparatus can start the printing operation. Particularly, in a case where the particle size of the pigment contained in a pigment ink is large, or in a case where the specific gravity of pigment particles is large, the pigment particles are settled down quickly. Even if the ink tank is left unused for several days, the ink in the ink tank may have a concentration distribution having adverse affects on printed images. In this case, the ink needs to be agitated every several days, and the printing apparatus can start no printing operation each time the ink is agitated.

FIG. 14 shows a concentration gradient of ink in a height direction of an ink tank. When no pigment is settled down, the concentration of the ink is homogeneous, and the ink has the same concentration in any height. However, once the ink is stored beyond a certain length of time, as shown by a curve B in FIG. 14, the concentration of the ink becomes lower in a higher portion in the tank, and gradually becomes closer to an initial concentration as the height becomes lower. The concentration of the ink in the middle of the ink tank is substantially equal to the initial concentration. On the other hand, the concentration of the ink becomes higher in a lower portion in the tank. In a portion closer to the lowermost portion (bottom portion) of the ink tank, particularly, the concentration of the ink changes (increases) suddenly. In general, the viscosity of the ink becomes higher as the concentration of pigment particles becomes higher. For this reason, the ink in the lowermost portion has higher specific gravity and viscosity than the ink in the other portions, and accordingly forms a layer which has properties largely different from those of the other portions.

To address this problem, in the ink tank described in Japanese Patent Laid-open No. 2007-230189, the ink leading-out port in the ink containing chamber is placed higher than the lowermost portion of the ink tank. Thereby, a sedimentary pigment settled down in the lowermost portion of the ink tank is prevented from moving into the ink supply port.

However, it is known that a sedimentary pigment thus settled down behaves like a viscous fluid, more specifically, has properties in which, once starting the movement, such sedimentary pigment moves while drawing its surrounding sedimentary pigment. For this reason, if the ink leading-out port in the ink containing chamber is formed in a horizontal surface when the ink tank is placed at a posture for use, most of the sedimentary pigment settled around the ink leading-out port may move into the ink leading-out port and further to the inside of the ink supply port, so that a desired effect cannot be obtained.

Furthermore, the placing of the ink leading-out port in a position higher than the bottom surface of the ink tank means that a portion in which the ink leading-out port is formed projects from the bottom surface of the ink containing chamber. This configuration, however, has the following problem in the case where the ink tank includes a flexible member for changing the volume of the ink containing chamber, and is configured to change the volume of the ink containing chamber in order to alleviate the increase in a negative pressure with the leading-out (consuming) of the ink while taking no atmosphere thereinto. In this case, as the amount of remaining ink in any of the ink tanks becomes smaller, the ink leading-out port may be covered by the flexible member, and the amount of ink which can be led out or supplied may vary from one ink tank to another.

Moreover, the agitating body is able to exert higher agitating performance when being placed in a position closer to the lowermost surface of the ink containing chamber in which a sedimentary pigment is settled down. However, depending on the height of a member forming the ink leading-out port, the agitating body has to be configured to avoid an interference with the member, so that the agitate body cannot be placed in a position where it can agitate effectively, or may be formed in a complicated shape. Consequently, the agitating performance of the agitating body may decrease.

SUMMARY OF THE INVENTION

An object of the present invention is to provide an ink tank capable of: effectively preventing a problem that high-concentration ink containing a sedimentary pigment is led out; exerting higher agitating performance; and stabilizing the amount of ink led out or supplied.

In an aspect of the present invention, there is provided an ink tank comprising: an ink containing chamber for containing ink; and an ink supply port for supplying the ink to an outside of the ink tank, the ink led out of the ink containing chamber through an ink leading-out port located in an inside of the ink containing chamber, wherein, when the ink tank is placed in a predetermined posture for use, the ink leading-out port is located higher than a lowermost portion of the ink containing chamber, and is formed in an inclined surface inclined to a gravitational direction.

In the present invention, the ink leading-out port, which is placed in the ink containing chamber and is used to supply the ink to a printing head, is located higher than the lowermost portion of the ink containing chamber. In addition, the ink leading-out port is formed in the inclined surface inclined to the gravitational direction. For this reason, even in a case where an ink tank containing ink including pigment components is left unused while mounted on the printing apparatus for a long period of time, the ink tank is capable of preventing high-concentration and high-viscosity ink containing a sedimentary pigment from being supplied to the ink leading-out port and further to the ink supply port.

Thereby, most of the sedimentary pigment are settled down in the ink containing chamber. For this reason, in the configuration in which agitating members are provided in the ink containing chamber, the ink can be sufficiently agitated by causing a carriage to reciprocate for a short time before a printing operation. Accordingly, the printing operation can be started immediately after the printing apparatus is activated. In addition, the ink tank is capable of homogenizing the concentration of the pigment, and thus enables the printing apparatus to print a high-quality image. Moreover, the ink tank is capable of reducing the amount of ink to be discharged when a printing operation is started after the ink tank is left unused for a long period of time, and accordingly reducing the running costs.

Additionally, even when the ink tank is configured to lead out ink, without taking atmosphere thereinto, but with a volume change of the ink containing chamber caused by displacement or deformation of a flexible member, the formation of the ink leading-out port in the inclined surface reduces the possibility that the ink leading-out port is closed by the flexible member. Accordingly, the ink tank allows the ink in the ink containing chamber to be ejected without waste, and thus offers a higher efficiency of ink use.

Further features of the present invention will become apparent from the following description of exemplary embodiments (with reference to the attached drawings).

DESCRIPTION OF THE EMBODIMENTS

Figure 1:
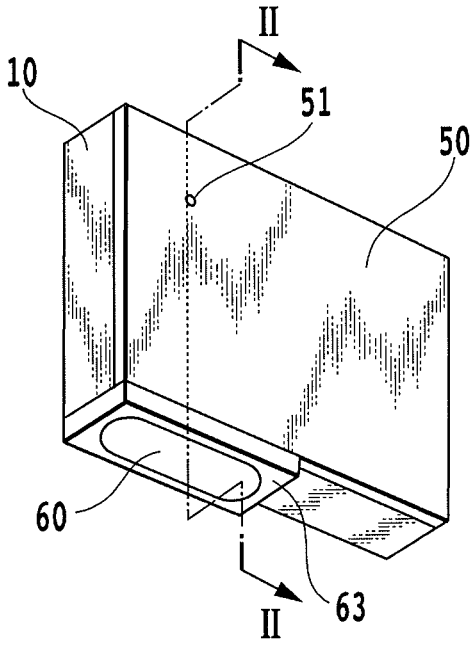
FIG. 1 is a perspective view showing an ink tank according to a first embodiment of the present invention.

Referring to the drawings, detailed descriptions will be hereinbelow provided for the present invention.

(Configuration of Ink Tank)

Figure 2:
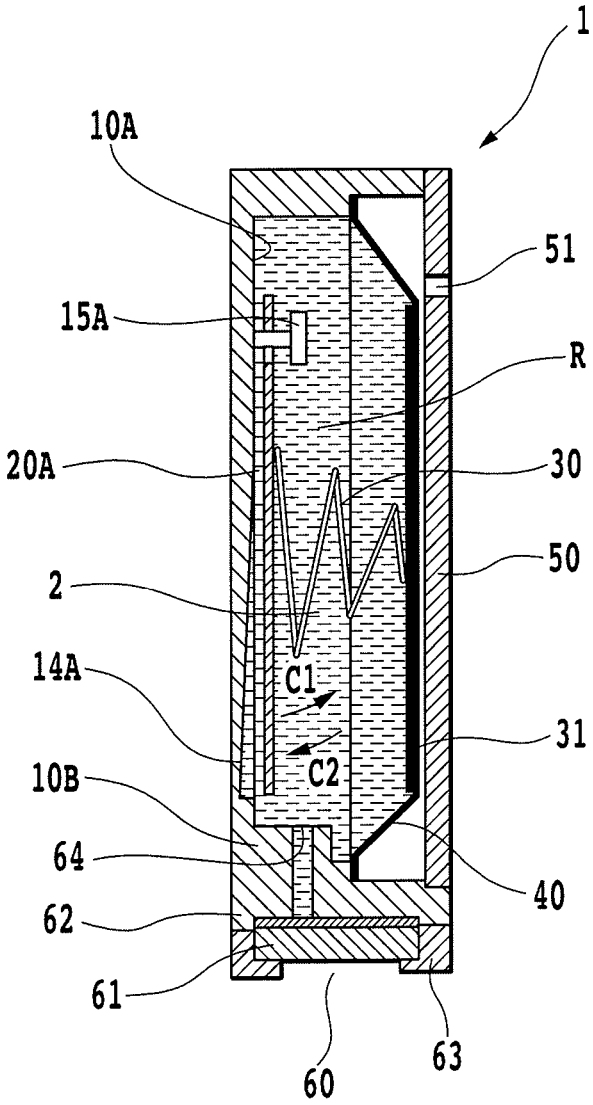
FIG. 2 is a cross-sectional view taken along the II-II line of FIG. 1.
Figure 3:
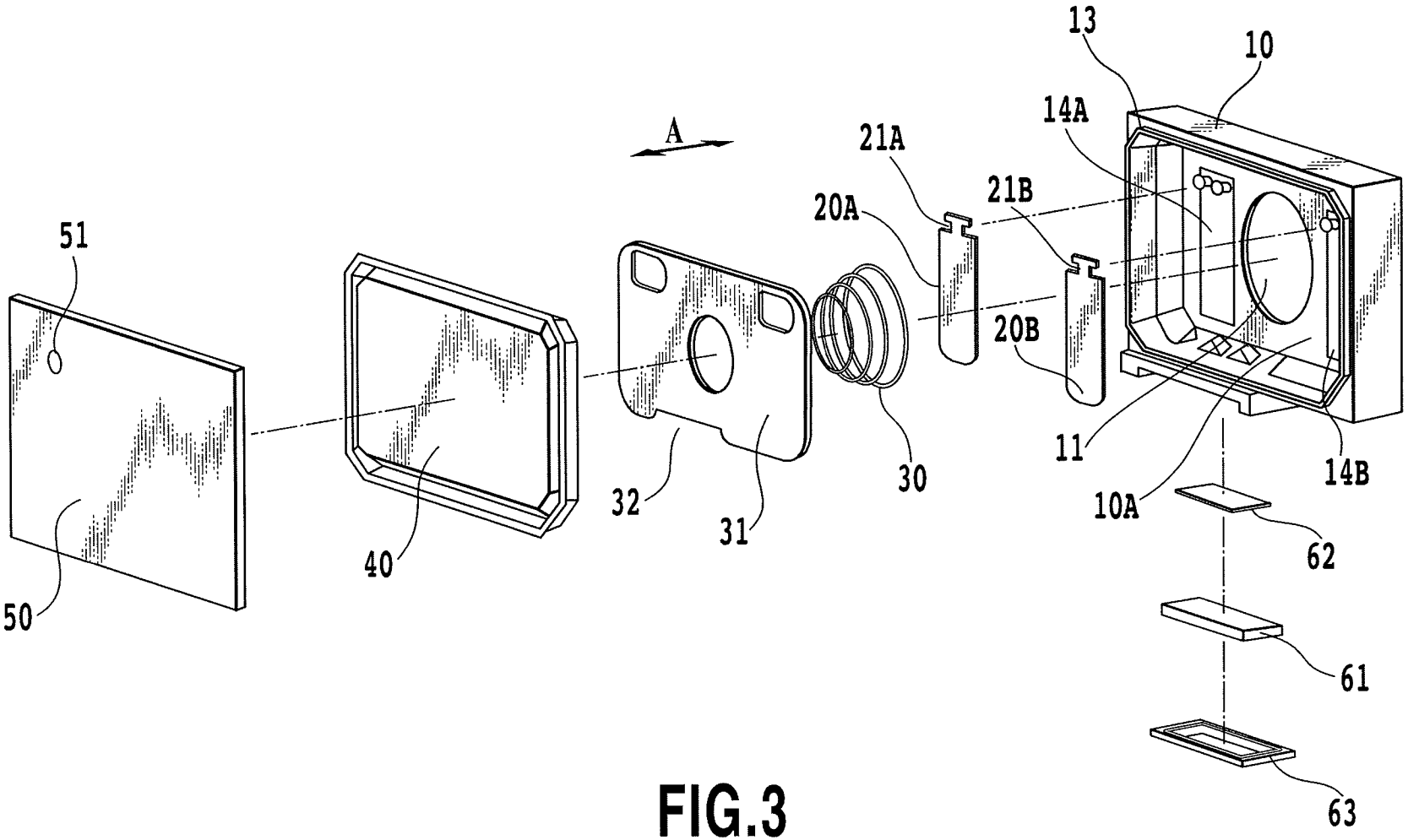
FIG. 3 is an exploded, perspective view of the ink tank shown in FIG. 1.
Figure 4A:
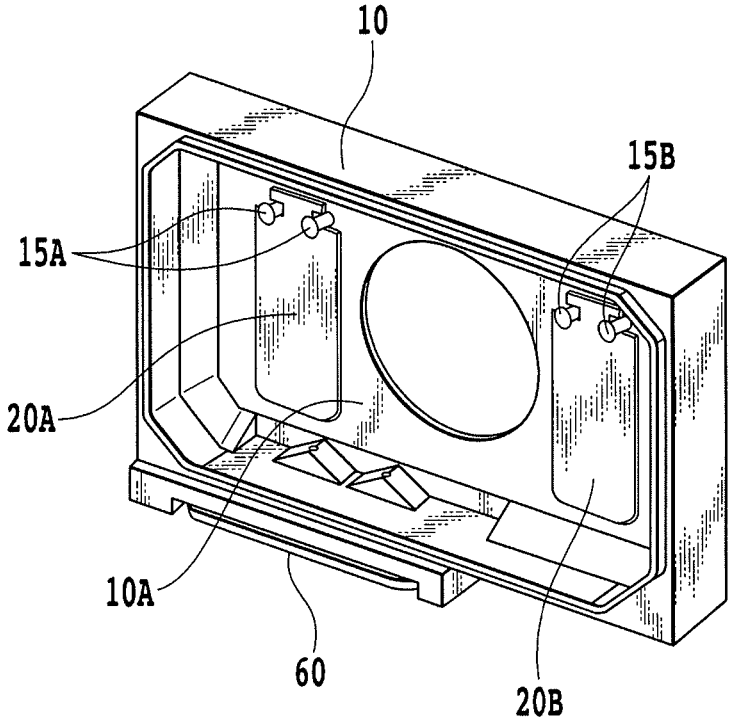
FIG. 4A is a perspective view of a tank case constituting a chief section of the ink tank according to the first embodiment.
Figure 4B:
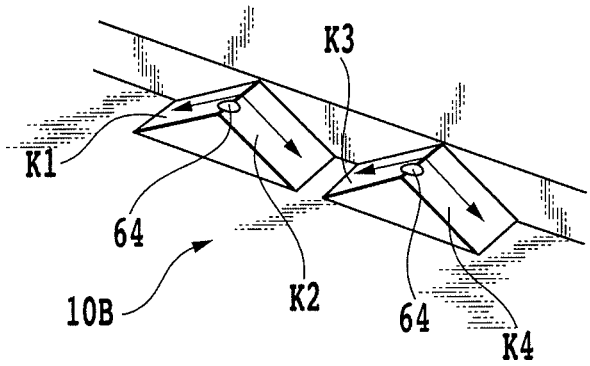
FIG. 4B is an enlarged perspective view showing a part of the tank case.

FIG. 1 is a perspective view of an ink tank 1 according to a first embodiment of the present invention. FIG. 2 is a cross-sectional view of the ink tank 1 taken along the II-II line of FIG. 1. FIG. 3 is an exploded, perspective view of the ink tank 1. FIG. 4A is a perspective view of a tank case constituting a chief section of the ink tank according to this embodiment. FIG. 4B is a perspective view showing a part of the tank case in an enlarged manner.

The ink tank 1 is a container for containing ink 2 in its ink containing chamber R configured by including the tank case 10 and a flexible member 40. Ink leading-out ports 64 placed in the ink containing chamber R communicate with an ink supply port 60. The ink tank 1 is attached to an inkjet printing apparatus with the ink supply port 60 directed downward in the vertical direction as shown in FIGS. 1 and 2. The ink supply port 60 is connected to an ink supply passage of an inkjet printing head, which will be described later. The ink tank 1 according to this embodiment is configured to be detachable from the printing head. Nevertheless, the ink tank 1 may be configured to integrally include the printing head.

As shown in FIGS. 2 and 3, the ink tank 1 is configured by chiefly including: the tank case 10; agitating members 20A and 20B; a spring member 30; a pressure plate 31; the flexible member 40; a lid member 50; a capillary force producing member 61; a meniscus holding member 62; and a supply port forming member 63. In particular, the tank case 10, the lid member 50 and the supply port forming member 63 constitute a housing body of the ink tank 1.

The ink supply port 60 capable of being connected to the inkjet printing head is formed in the supply port forming member 63. On the other hand, the ink leading-out ports 64 and a passage forming part 10B are formed in the tank case 10. Through the ink leading-out ports 64, the ink is led out of the ink containing chamber R. In the passage forming part 10B, passages from the respective ink leading-out ports 64 to the ink supply port 60 are formed (described in detail later). As shown in FIG. 3, the capillary force producing member 61 and the meniscus holding member 62 are disposed in the ink supply port 60. The capillary force producing member 61 produces a capillary force, and is formed of a flexible material so that the capillary force producing member 61 is capable of alleviating a vertical displacement (vertical direction in FIG. 2) of the printing head when the ink supply port 60 is connected to the printing head. As described later, the pressure inside the ink containing chamber R is kept negative in order that no portion of the ink should leak to the outside of the ink containing chamber R through the ink supply port 60. The meniscus holding member 62 forms a meniscus of the ink in a way that no air bubble is sucked through the ink supply port 60 due to the negative pressure of the ink containing chamber R. To this end, for the meniscus holding member 62, a material which produces a meniscus holding force stronger than a maximum value of the negative pressure generated in the ink containing chamber R is selected.

The agitating members 20A and 20B located in the ink containing chamber R are attached to the inside of the tank case 10 so as to be swingable in directions indicated by arrows C1 and C2 in FIG. 2. The agitating members 20A and 20B according to this embodiment are plate-shaped members made chiefly of a metal. As shown in FIGS. 3 and 4A, the agitating members 20A and 20B are supported by supporting parts 15A and 15B at their concave portions 21A and 21B, respectively. Here, the supporting parts 15A and 15B are provided on the inner wall of the tank case 10.

Each of the supporting parts 15A and 15B is configured by including a pair of shaft portions extended to be parallel to a moving direction of a carriage of the printing apparatus and a pair of stopper portions. The pairs of shaft portions are inserted into the concave portions 21A and 21B provided in the upper ends of the agitating members 20A and 20B, respectively, so as to swingably support the agitating members 20A and 20B. The pairs of stopper portions prevent the agitating members 20A and 20B from coming off their pairs of shaft portions. The supporting parts may be members each shaped like a rivet, and each obtained by thermally processing a front portion of a boss projecting from the tank case 10 made of a resin material so that the front portion is enlarged. In other words, each portion projecting from the tank case 10 may be used as a shaft portion, and each portion enlarged by thermal process may be used as a stopper portion.

In addition, concave dug portions 14A and 14B corresponding to the sizes and shapes of the agitating members 20A and 20B are formed in the inner wall 10A of the tank case 10. The agitating members 20A and 20B are capable of entering the concave dug portions 14A and 14B, respectively.

The spring member 30 is a conical coil spring, and is positioned in a concave portion 11 formed in the inner wall 10A of the tank case 10. The spring member 30 is located so that the load center of the spring member 30 almost coincides with the center of gravity of the pressure plate 31. The peripheral portion of the flexible member 40 is welded to a welding portion 13 of the tank case 10. Thus, the flexible member 40 and the tank case 10 constitute a space which is closed except for the ink supply port 60, which is the ink containing chamber R.

The shape of a center portion of the flexible member 40 according to this example is restrained by the pressure plate 31 which is a supporting member shaped like a plate. The peripheral portion of the flexible member 40 is deformable. The center portion of the flexible member 40 is beforehand formed in a convex shape, and the cross-sectional shape of the center portion thus looks like a trapezoid. As described later, this flexible member 40 deforms depending on the change in the amount of ink and the change in the internal pressure inside the ink containing chamber R. When the flexible member 40 deforms, the peripheral portion of the flexible member 40 flexibly deforms in a well-balanced manner, and the center portion of the flexible member 40 moves leftward or rightward in FIG. 1 in a way that the center portion is kept almost in parallel with the inner wall 10A of the tank case 10. Because the flexible member 40 smoothly deforms (or moves) in this manner, the internal pressure inside the ink containing chamber R does not abnormally change due to an impact which would otherwise occur.

As a compressed spring, the spring member 30 biases the flexible member 40 via the pressure plate 31 leftward in FIG. 3 (or rightward in FIG. 2). When the biasing force of the spring member 30 acts in a direction in which the ink containing chamber R is enlarged, a predetermined negative pressure occurs in the inside of the ink containing chamber R. In this manner, the ink in the printing head is imparted with a negative pressure which is equilibrium with the holding force of an ink meniscus formed in an ink ejecting portion, and which is in a range possible for the printing head to perform an ink ejecting operation. In other words, a negative pressure in a range which enables the printing head to perform an ink ejecting operation occurs in the ink containing chamber R. FIG. 2 shows a condition in which the inside of the ink containing chamber R is almost fully filled with the ink. In this condition, the spring member 30 is in the compressed condition, and an appropriate negative pressure occurs in the ink containing chamber R.

The lid member 50 is attached to an opening portion of the tank case 10. The flexible member 40 is protected by the lid member 50. An atmosphere communication portion 51 is provided to the lid member 50. The outside of the ink containing chamber R in the tank case 10 is at atmospheric pressure. The internal pressure inside the ink containing chamber R is negative to the atmospheric pressure by an amount corresponding to a combination of a pressing load which the spring member 30 imposes on the pressure plate 31 and a pressure applied to an area of the flat surface of the flexible member 40.

As the ink 2 almost fully filled in the ink containing chamber R as shown in FIG. 2 is consumed while supplied to the printing head, the pressure plate 31 moves leftward in FIG. 2 against the biasing force of the spring member 30. In response, the flexible member 40 deforms. The internal negative pressure inside the ink containing chamber R slightly increases in accordance with an increase in load imposed by the spring member 30 when the spring member 30 is compressed. As the ink is further consumed, the volume of the inside of the ink containing chamber R decreases to such an extent that the pressure plate 31 cannot be displaced any more by coming into contact with the inner bottom surface of the tank case 10. The spring member 30 is formed as the conical coil spring whose wire does not interfere with itself anywhere for the purpose of making the thickness of the spring member 30 equal to its line diameter when the spring member 30 is compressed to maximum. The spring member 30 does not obstruct the displacement of the pressure plate 31, because the spring member 30 is completely withdrawn into the concave portion 11 when the spring member 30 is compressed to maximum.

As the pressure plate 31 is increasingly displaced in accordance with the consumption of the ink 2, the swingable range of each of the agitating members 20A and 20B decreases because the pressure plate 31 restrains the swings of the agitating members 20A and 20B. However, the agitating members 20A and 20B are still swingable because the respective dug portions 14A and 14B are formed in the tank case 10. In addition, the displacement of the pressure plate 31 is not obstructed by the agitating members 20A and 20B. Furthermore, although the ink leading-out ports 64 are located above the lowermost surface of the ink containing chamber R, the pressure plate 31 can be displaced until the pressure plate 31 comes in contact with the inner wall 10A of the tank case 10. That is because a notch portion 32 whose shape corresponds to the shapes of the respective ink leading-out ports 64 is formed in the pressure plate 31. Moreover, in this example, no air is taken into the ink containing chamber R from the outside of the ink tank. Thus, ink located under the ink leading-out ports 64 can be supplied to the printing head.

As shown in FIG. 4A, the ink leading-out ports 64 in the ink containing chamber R are placed in positions higher than the lowermost surface (bottom surface) of the ink containing chamber R.

The inventors examined how high a sedimentary layer would settle in the lowermost portion of the ink in the gravitational direction in a case where the ink tank was stored at a certain posture (in a condition shown in FIG. 2) for a long period of time. The inventors carried out this examination by use of an ink containing a 4-percent concentration of pigment particles which was most apt to sediment, and found that the height of the sedimentary layer reached approximately 3% of the height of the ink containing chamber. With this fact taken into consideration, the inventors have configured the ink tank 1 according to this embodiment in a way that the ink leading-out ports 64 are located in positions higher than the bottom surface of the ink containing chamber by a height equivalent to 3% or more of the height of the ink containing chamber.

In a case where the ink tank 1 thus configured is left unused in a usable condition where the ink tank 1 attached to the printing apparatus (where the ink supply port 60 is directed downward), the sedimentary pigment layer settles to the lowermost portion of the ink containing chamber. In a case where, as described above, each ink leading-out ports is provided in the lowermost portion of the ink containing chamber, the sedimentary pigment layer enters the ink leading-out port while drawing the other sedimentary pigment layers existing in its vicinity. The sedimentary pigment moves downstream of the ink leading-out port, and massively settles to the capillary force producing member 61. Once the sedimentary pigment settles there in this manner, it is impossible to agitate the ink by the operation of the agitating members 20A and 20B provided in the ink containing chamber. Accordingly, the sedimentary pigment may flow into the printing head during a printing operation. As a result, the sedimentary pigment flowing into the printing head may deteriorate the printing quality, or may cause ejection failures such as clogging in the ejection openings.

On the contrary, in the present embodiment, the sedimentary pigment settling while the ink tank is left unused is prevented from entering the ink leading-out ports 64, basically because the ink leading-out ports 64 are placed in the positions higher than the height of the settling sedimentary pigment. In other words, in the present embodiment, the sedimentary pigment can be prevented from settling in an area in which the ink is incapable of being agitated in the ink tank, even in the case where the ink tank is left unused while attached to the printing apparatus for a long period of time, particularly, left unused while stored at a certain posture where the supply port 60 faces downward.

Furthermore, in the present embodiment, as shown in FIG. 4B, the two ink leading-out ports 64 are provided in the passage forming portion 10B of the tank case 10. Each of the two ink leading-out ports 4 is provided in an apex of an raised portion whose cross-section is triangular, that is, in a ridge portion formed by connecting two inclined planes together. In other words, when the passage forming portion 10B is placed with the ink supply port 60 facing downwards, the passage forming portion 10B has a raised portion in each ink leading-out port 64 and its vicinity. The raised portion has a shape whose apex is constituted of the ink leading-out port 64, and whose inclined planes descend in the gravitational direction. Because of the raised portion, most of the sedimentary pigment in the vicinity of each ink leading-out port 64 slides down the inclined planes, and thus goes away from the ink leading-out port 64, and accordingly moves to the bottom surface of the ink containing chamber R which is away from the ink leading-out port 64. This scheme makes it hard for the ink to be drawn into each of the ink leading-out port 64 when the ink moves in response to the leading out of the ink.

In addition to this effect, the following effect can be obtained from the configuration according to the present embodiment.

Figure 5:
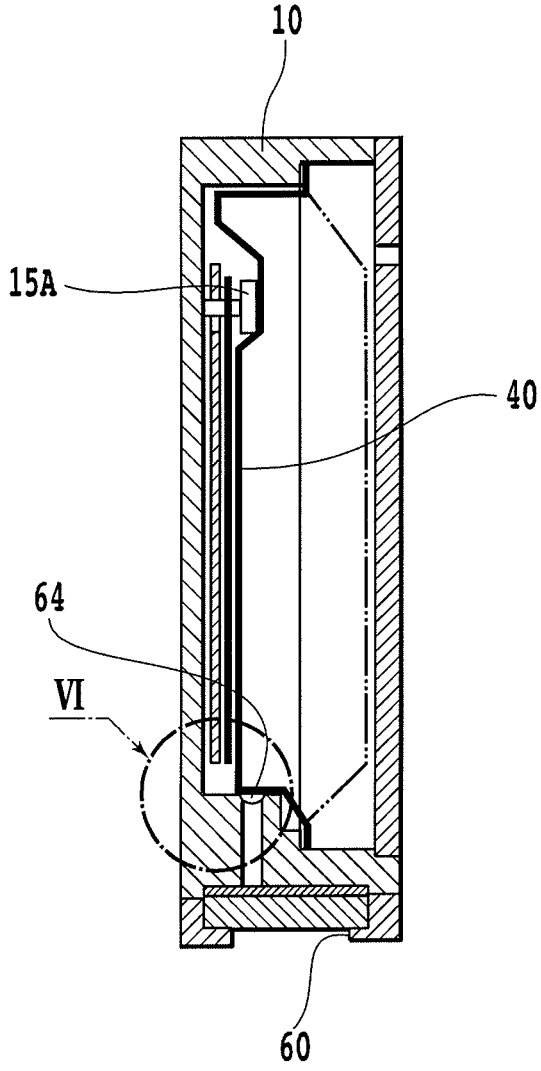
FIG. 5 is a cross-sectional view of the ink tank according to the first embodiment, and shows a condition where the ink in an ink containing chamber is being used.
Figure 6:
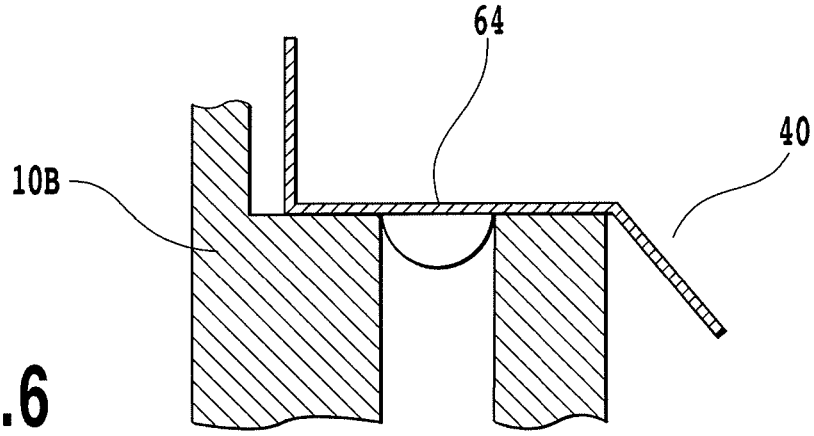
FIG. 6 is a schematic, enlarged view of an ink leading-out port 64 and its vicinity in the ink tank according to the first embodiment, and explains a condition where the ink in the ink containing chamber is almost completely used up.

FIG. 5 is a cross-sectional view of the ink tank 1, and shows a state where the ink 2 in the ink containing chamber R is being used. FIG. 6 is a schematic, enlarged view of one of the ink leading-out port 64 and its vicinity (section B shown in FIG. 5).

As shown in FIG. 5, the ink 2 is discharged from the inside of the ink containing chamber R to the outside through the ink leading-out ports 64, and the ink containing chamber R changes its volume as a result of the deformation of the flexible member 40. When the amount of ink remaining in the ink containing chamber R becomes small, the deformation of the flexible member 40 due to the change in the volume of the ink containing chamber R causes the flexible member 40 to cover the ink leading-out ports 64 as shown in FIG. 6. If the top of the raised portion of the passage forming portion 10B in which the ink leading-out ports 64 exist is formed in the shape of a flat surface, the ink leading-out ports 64 would be closed by the flexible member 40 as described above. Thus, the ink may not be led out through the ink leading-out ports 64. In this case, the amount of ink capable of being led out or supplied would become unstable. As a result, the ink may not be ejected during the printing operation, and thereby causing a printing failure.

On the contrary, in this embodiment, one of the ink leading-out ports 64 is placed in a ridge portion in which the inclined surface K1 and the inclined surface K2 of one raised portion join together, and the other of the ink leading-out ports 64 is placed in the other ridge portion in which the inclined surface K3 and the inclined surface K4 of the other raised portion join together. Consequently, as shown in FIG. 6, each ink leading-out port 64 is widely formed in an area extending from the ridge in which the inclined surfaces join together to positions located along the inclined surfaces which are lower than the ridge. Accordingly, each ink leading-out port 64 includes no flat surface which is opposed to the flexible member 40. Specifically, even when the flexible member 40 is in contact with the each ridge portion, a predetermined gap is formed between the flexible member 40 and each ink leading-out port 64. Thereby, the ink leading-out ports 64 are not closed by the flexible member 40. This makes it possible for the ink to be stably supplied until the last ink droplet.

Figure 7:
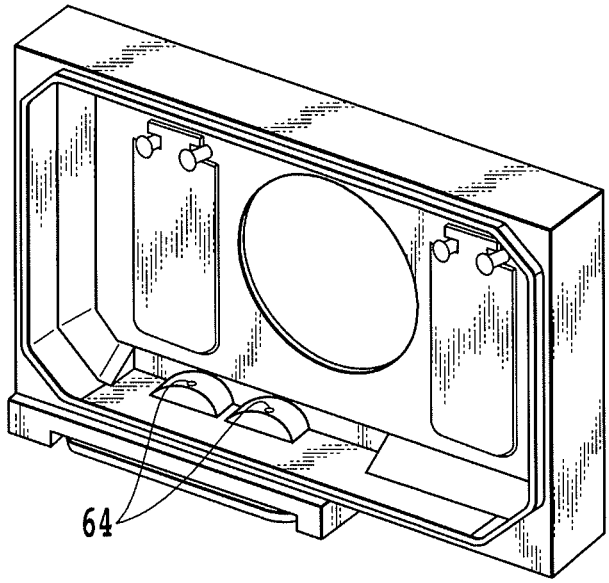
FIG. 7 is a perspective view showing an internal configuration of an ink tank according a modification of the first embodiment.

FIG. 7 shows a modification of this embodiment. In the modification, each raised portion in which the corresponding ink leading-out port 64 and its passage are formed has a semicircular cross-section. Each ink leading-out port 64 is formed in an apex of the corresponding semicircular raised portion, which is the farthest from the bottom surface of the ink containing chamber R. This modification offers the same operation/effect as the above-described embodiment. Any shape may be selected, depending on the necessity, for the raised portions in which the respective ink leading-out ports 64 are provided, as long as the desired effect of the present invention can be expected from the shape.

In addition, neither the number of ink leading-out ports 64 nor the number of raised portions is limited to the respective numbers shown in the drawings. The necessary numbers of ink leading-out ports 64 and raised portions to be disposed may be set depending on a required flow rate of ink and a pressure loss of each passage.

As described above, it is desirable that the ink leading-out ports 64 should be placed in positions higher than the bottom surface of the ink containing chamber R. However, when the ink leading-out ports 64 are placed in position higher than necessary, a problem may occur in the ink agitating performance.

Figure 8:
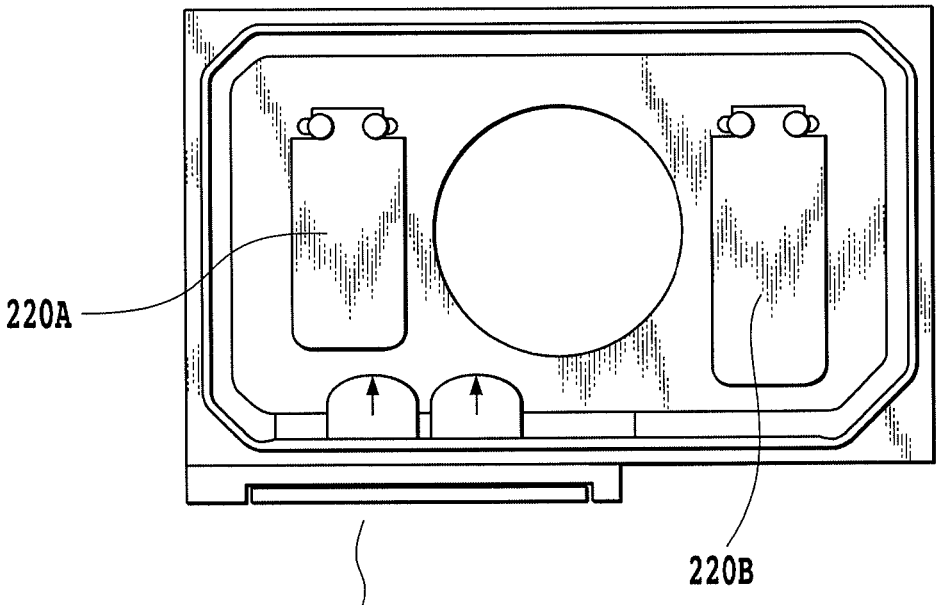
FIG. 8 is an explanatory view for explaining a design criterion for selecting the position (height) of the ink leading-out port.

FIG. 8 is a schematic view showing an internal configuration of an ink tank, which is used to explain this problem. As shown in FIG. 8, the ink leading-out ports 64 are formed in positions higher than the bottom surface of the ink containing chamber R. In such a case where the raised portions in which the ink leading-out ports 64 and the passages are formed are set high, if both of the left and right agitating members 220A and 220B are set long enough to have the same length, the raised portions interfere with the agitating member 220A. If the length of the agitating member 220A is set shorter than the length of the agitating member 220B for the purpose of avoiding this interference, the agitation effect of the agitating member 220A decreases, and the agitation balance between the left and right agitating members 220A and 220B is accordingly disturbed. As a result, the ink is no longer sufficiently agitated in the vicinities of the ink leading-out ports.

For this reason, in the ink tank according to this embodiment, each ink leading-out port should be designed to be positioned at an adequate height depending on the initial concentration of a pigment and the sedimentation rate of the pigment. By this design scheme, a configuration can be obtained in which the agitation effect is not decreased, and no sedimentary pigment settles in the areas not agitated.

(Configuration of Inkjet Printing Apparatus)

Figure 9:
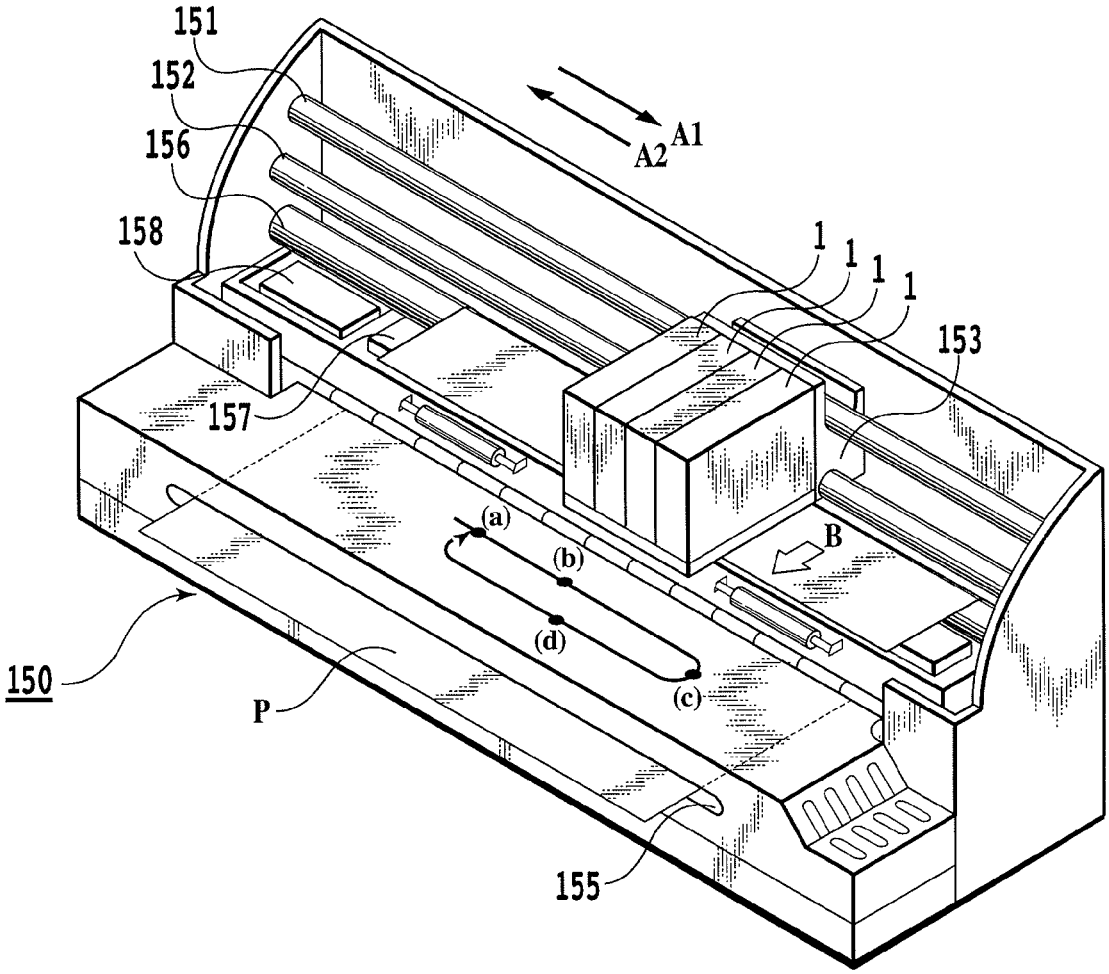
FIG. 9 is a perspective view used to explain a configuration example of an inkjet printing apparatus to which the present invention can be applied.

FIG. 9 is a drawing used to explain a configuration example of an inkjet printing apparatus to which the present invention can be applied.

A printing apparatus 150 of this example is a serial scan type inkjet printing apparatus. A carriage 153 is guided by guide shafts 151 and 152 so as to be movable in directions indicated by arrows A1 and A2. The carriage 153 is reciprocated in the A1 and A2 directions by a carriage motor and a drive force transmitting mechanism such as a belt for transmitting the drive force from the carriage motor. An inkjet printing head (not illustrated) and the above-described ink tank 1 for supplying the ink to this printing head are mountable on the carriage 153. Four ink tanks 1 are mounted on the carriage 153 in this example. Nevertheless, the number of ink tanks 1 mounted may be arbitrarily one or more.

A sheet P as a printing medium is inserted through an insertion opening 155 provided in the front end portion of the apparatus. Thereafter, the conveyance direction of the sheet P is reversed. Accordingly, the sheet P is conveyed in a direction indicated by an arrow B by a conveyance roller 156. The printing apparatus 150 alternately repeats the printing operation and a conveyance operation, and thus sequentially prints an image. The printing operation is an operation of ejecting ink onto a printing area on the sheet P placed on a platen 157 while moving the printing head together with the carriage 153 in the A1 or A2 direction. In addition, the conveyance operation is an operation of conveying the sheet P in the B direction, for instance, by a distance corresponding to a width of an area in which an image is printed each time the printing head is moved.

Reference signs (a), (b), (c) and (d) in FIG. 9 denote positions on an imaginary trail along which the carriage 153 moves while reciprocating in the directions indicated by the respective arrows A1 and A2. The position (a) denotes a position of the carriage 153 when the carriage 153 starts to move in an forward direction indicated by the arrow A1. The position (b) denotes a position of the carriage 153 when the carriage 153 is moving in the direction indicated by the arrow A1. The position (c) denotes a position of the carriage 153 when the carriage 153 subsequently reverses its movement direction and starts to move in the direction indicated by the arrow A2. The position (d) denotes a position of the carriage 153 when the carriage 153 continues move in the direction indicated by the arrow A2. The ink 2 in the ink tank 1 is agitated by use of this reciprocating motion of the carriage 153 in the directions indicated by the respective arrows A1, A2, as described later.

The printing head may use thermal energy produced by electrothermal transducer elements as energy for ejecting ink. In this case, ink can be ejected through the ink ejection openings by use of foaming energy which is caused when the ink is film-boiled by heat produced by the electrothermal transducer elements. However, the ink ejecting system which can be adopted for the printing head is not limited to the present example using the electrothermal transducer elements. For instance, the ink ejecting system using piezoelectric elements or the like may be adopted.

A recovery unit 158 opposed to a face (ejection face), on which the ejection openings are formed, of the printing head mounted on the carriage 153 is provided in the left end of the area in which the carriage 153 moves, as shown in FIG. 9. The recovery unit 158 includes: a cap capable of covering the ejection face of the printing head; and a suction pump capable of introducing a negative pressure into the cap. Thus, for the purpose of keeping the printing head in a suitable ink ejection condition, the recovery unit 158 is capable of performing a recovery process which includes: introducing the negative pressure into the cap covering the ejection face; and causing ink to be sucked and discharged through the ink ejection openings. In addition, for the purpose of keeping the printing head in a suitable ink ejection condition, the recovery unit 158 is capable of performing a recovery process (also referred to as a "preliminary ejection process") of causing ink making no contribution to the printing of an image to be ejected into the cap through the ink ejection openings.

(Mechanism for Agitating Ink)

FIGS. 10A, 10B, 10C and 10D are cross-sectional views used to explain an agitation operation of the ink 2 performed by the agitating member 20A. FIGS. 10A, 10B, 10C and 10D show the agitating operation performed when the carriage 153 is in positions (a), (b), (c) and (d) in FIG. 9, respectively. The agitating member 20B operates in the same manner as the agitating member 20A.

Figures 10A, 10B, 10C, 10D:
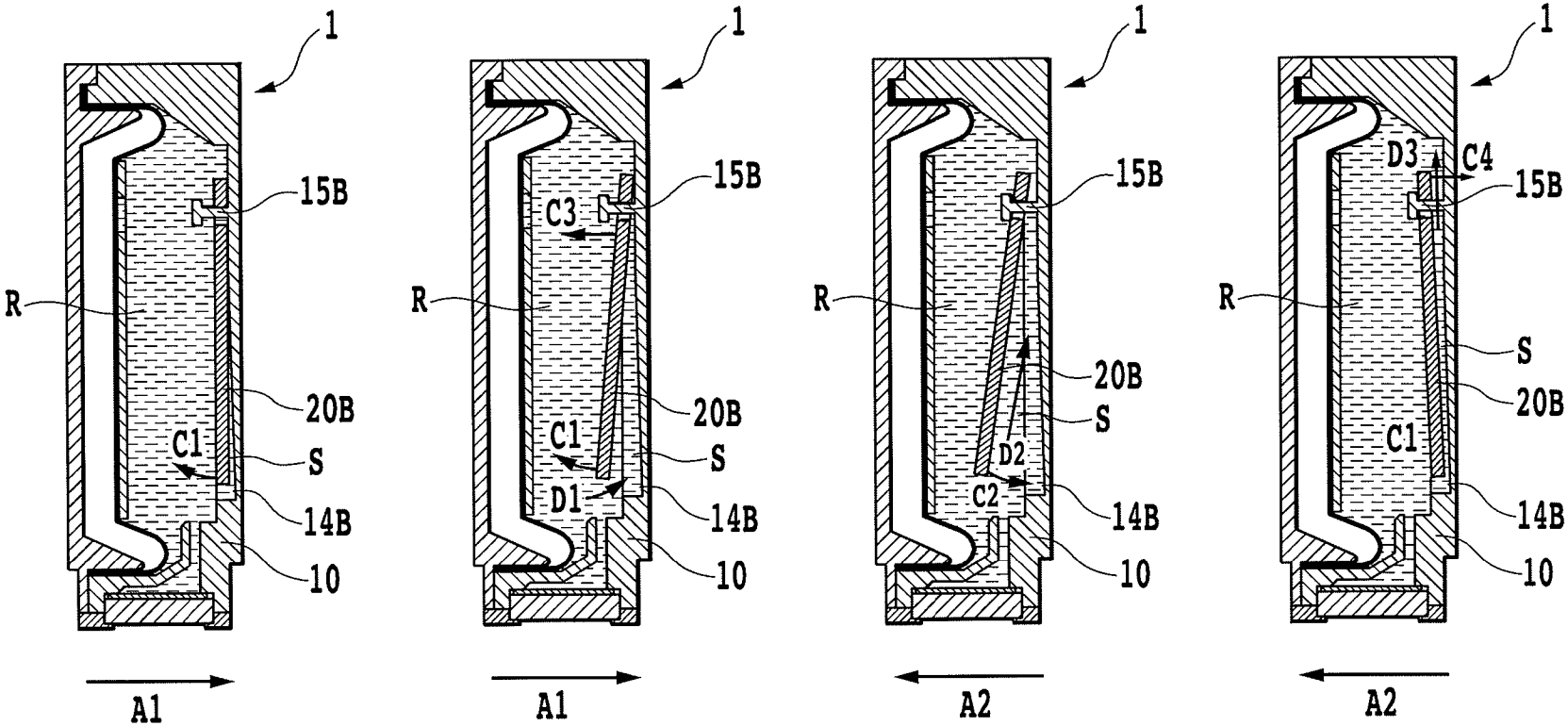
FIGS. 10A to 10D are schematic, cross-sectional views each used to explain an agitating mechanism in the ink tank according to the first embodiment.

First, when the carriage 153 starts to move in the direction indicated by the arrow A1, the agitating member 20A in the ink tank starts to rotate around the supporting part 15A in a direction indicated by an arrow C1 due to an inertial force as shown in FIG. 10A. Once the agitating member 20A starts to rotate in the direction indicated by the arrow C1, a space S between the agitating member 20A and the inner wall 10A becomes wider. Accordingly, ink starts to flow into the space S thus becoming wider.

Subsequently, as the carriage 153 further moves in the direction indicated by the arrow A1, the rotation angle of the agitating member 20A reaches a maximum angle at which the agitating member 20A is rotatable within a gap between the concave portion 21A of the agitating member 20A and the shaft of the supporting part 15A as shown in FIG. 10B. Accordingly, ink flows into the thus formed space S as indicated by an arrow D1. In this state, the inertial force continues acting upon the agitating member 20A because the carriage 153 still continues moving in the direction indicated by the arrow A1, although the rotation angle of the agitating member 20A has reached the maximum angle. Accordingly, the supporting part-side end portion of the agitating member 20A starts to move in a direction indicated by an arrow C3.

Thereafter, when the carriage 153 starts to move in the direction indicated by the arrow A2 after reversing its movement direction, the volume of the space S becomes the largest as shown in FIG. 10C. As the carriage 153 decelerates and then accelerates in the direction indicated by the arrow A2, the agitating member 20A once having swung to the maximum in the direction indicated by the arrow C1 starts to swing in a direction indicated by an arrow C2. Thereby, the distance between the agitating member 20A and the inner wall 10A starts to decrease, and the ink flows further upward in a direction indicated by an arrow D2.

Afterward, as the carriage 153 continues moving in the direction indicated by the arrow A2, the free end of the agitating member 20A comes closer to the inner wall 10A, and the ink in the space S is pushed out toward a gap between the supporting part-side end portion of the agitating member 20A and the inner wall as indicated by an arrow D3 as shown in FIG. 10D. In this respect, if the flow resistance of the ink pushed out of the space S is larger than the inertial force acting upon the agitating member 20A, the speed at which the agitating member 20A swings decreases to a large extent. Accordingly, it is desirable to adjust the accelerating force of the carriage 153, the mass of the agitating member 20A and the like so that the inertial force acting upon the agitating member 20A is set larger than the flow resistance of the ink. After that, as the inertial force continues acting upon the agitating member 20A, the supporting part-side end portion of the agitating member 20A starts to move in a direction indicated by an arrow C4.

Because the ink flows in this manner, it is possible to increase the agitating efficiency of the all ink in the ink containing chamber R. Because a frictional resistance occurs between the agitating member 20A and the supporting part 15A, it is possible to cause the free end of the agitating member 20A to start to move first, and to cause the supporting part-side end portion of the agitating member 20A to start to move later. This movement causes the pumping effect, which enables the ink in the lower portion of the ink containing chamber to be circulated upward. In addition, because the free end of the agitating member 20A which is capable of moving wide is placed in the lower place in the vertical direction, it is possible to more efficiently agitate pigment components which settle in the lower portion of the ink containing chamber. The synergy between this pigment component agitation and the pumping effect makes it possible to stir up all the ink in the ink containing chamber.

Thereafter, the agitating member 20A returns to the condition shown in FIG. 10A from the condition shown in FIG. 10D. Subsequently, as long as the carriage 153 continues reciprocating, the conditions shown in FIGS. 10A, 10B, 10C and 10D are repeated.

In a case where the printing apparatus with the ink tank 1 being mounted on the carriage 153 is left unused for a long period of time, pigment components in the ink sediment in the ink tank 1. This sedimentation causes a concentration distribution in which the concentration of the ink in the ink tank 1 is not homogenized in the vertical direction. The ink in this ink tank 1 can be efficiently agitated by causing an upward ink flow as described above. This efficient agitation enables the concentration of the ink in the ink containing chamber to be securely homogenized in a short period of time.

Furthermore, in this example, as described above, each ink leading-out port 64 is placed in the position higher than the lowermost surface of the ink containing chamber R. As a result, even though a portion of the sedimentary ink immediately above each ink leading-out port 64 reaches the meniscus holding member 62 or the capillary force producing member 61, the other portion of the sedimentary ink does not enter the ink leading-out port 64. In other words, in this embodiment, each ink leading-out port 64 is placed in the position higher than the height to which the ink layer with high ink concentration exists. For this reason, even though the portion of the sedimentary ink immediately above each ink leading-out port 64 which exist above the aforementioned height enters the ink leading-out port 64, the other portion of the sedimentary ink does not enter the ink leading-out port 64. Particularly, because each ink leading-out port 64 is formed in the corresponding ridge portion in which the inclined surfaces join together, as described above, instead of in the horizontal surface, it is possible to prevent the sedimentary ink from entering each ink leading-out port 64 more effectively.

Moreover, not ink with the highest concentration, but ink whose concentration is slightly higher than its initial concentration enters the ink leading-out ports 64. For this reason, in a certain storage period, ink between each ink leading-out port 64 and its corresponding capillary force producing member 61 need not be discharged by a recovery operation performed before starting the printing operation. For instance, the operation (the reciprocating movement of the carriage) as shown in FIGS. 10A to 10D may be carried out several times before the printing operation, and the printing operation can be carried out immediately thereafter.

Figure 14:
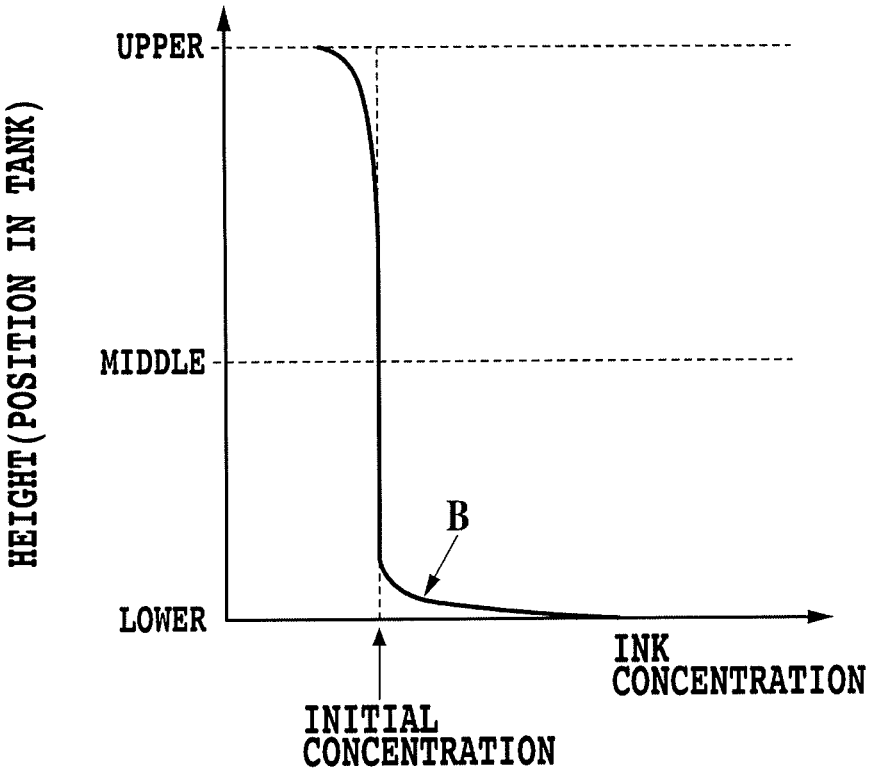
FIG. 14 is a graph showing a relationship between an ink concentration and a position of ink sediment in the tank when there is ink sediment.

When the ink tank is stored, at the start of its usage, ink with higher concentration resulting from the sedimentation of pigment components exists in the vicinity of the lowermost surface of the ink containing chamber R. However, in a case where the certain height is secured for each ink leading-out port 64 as with the present embodiment, the concentration of ink located in each ink leading-out port 64 may be equal to the initial concentration suitable for a printing in a relatively short storage period, as shown in a concentration gradient in FIG. 14. Here, the ink with the suitable concentration can be supplied to the printing head without agitating the ink before starting the printing operation. Thereafter, the ink in the ink containing chamber R may be agitated so that the concentration of the ink is homogenized. Thereby, all of the ink can be used with the suitable concentration.

In the present embodiment, the ink leading-out ports 64 are placed in the positions higher than the lowermost surface of the ink containing chamber. This makes it possible to reduce the user's waiting time from the activation of the printing apparatus to the start of the printing operation, and the printing operation can be started immediately.

The swingable ranges of the agitating members 20A and 20B gradually becomes smaller as the pressure plate 31 comes closer to the inner side surface of the tank case 10 due to consumption of the ink in the ink containing chamber R. However, in the present embodiment, the agitating members 20A and 20B can maintain their agitating functions until all the ink are consumed. That is because the dug portions 14A, 14B are formed in the tank case 10. Furthermore, in the present embodiment, the lateral width of the ink tank 1 in FIG. 1 can be set a narrower while securing the swingable ranges for the agitating members 20A and 20B. Consequently, in the present example, multiple ink tanks 1 can be compactly arranged one after another on the carriage 153 in the directions indicated by the arrows A1 and A2.

Second Embodiment

Figure 11A:
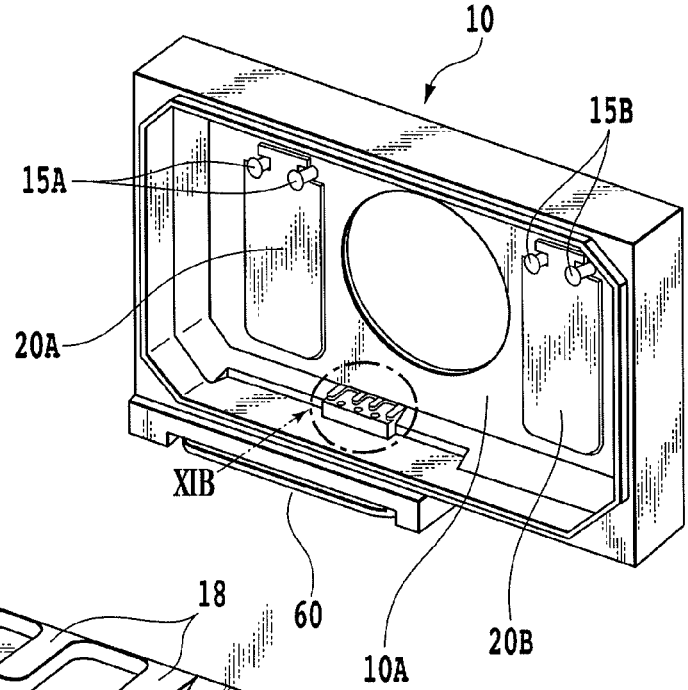
FIG. 11A is a schematic, perspective view showing an internal configuration of an ink tank according to a second embodiment of the present invention.
Figure 11B:
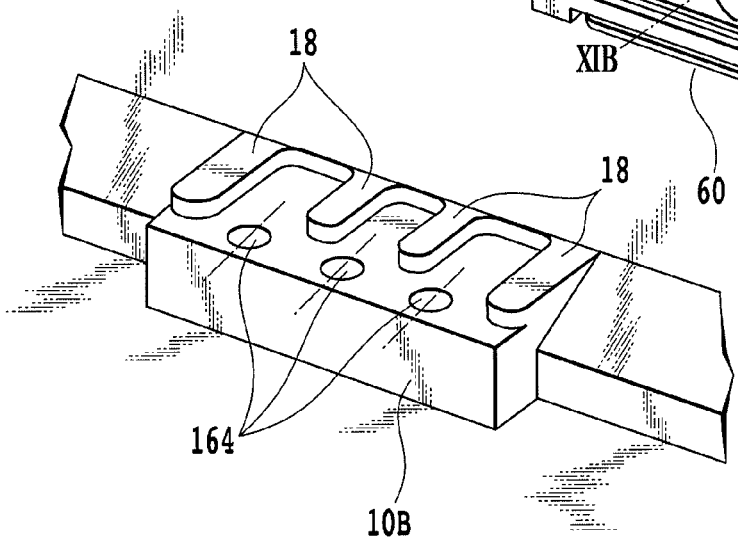
FIG. 11B is an enlarged view of a part thereof.

FIG. 11A is a schematic perspective view showing an internal configuration of an ink tank according to a second embodiment of the present invention. FIG. 11B is a partially enlarged view showing the internal configuration thereof.

Component parts which are the same as those of the first embodiment will be denoted by the same reference numerals, and descriptions thereof will be omitted.

The ink tank according to this embodiment includes three ink leading-out ports 164 formed in a flat surface. This forming surface is not a horizontal surface, but a surface which is inclined to the gravitational direction when the ink tank is attached to the printing apparatus. In a case where the tank case 10 is a resin-molded component, the inclination angle of this forming surface may be an angle formed corresponding to a generally-used draft which is needed when a die is formed. In addition, convex-shaped bumps 18 extend from the inner wall 10A of the ink containing chamber along both outer sides of the area where the ink leading-out ports are arranged, and toward a place between each adjacent two of the ink leading-out ports.

In this embodiment, the multiple ink leading-out ports 164 (three in the drawings) are provided in the single flat surface. This makes it possible to reduce an unusable ink capacity which is formed between the passage forming portion 10B and the flexible member 40 displaced to the maximum due to consumption of the ink. In other words, in the first embodiment, because the multiple ink leading-out ports 164 and their corresponding passages are formed in the respective raised portions of the passage forming portion 10B, the volume of the space between the raised portions may constitute the unusable ink capacity. On the contrary, the present embodiment makes it possible to reduce such an unusable ink capacity, and accordingly makes it possible to further reduce the amount of unusable ink remaining in the ink containing chamber R.

Moreover, in the present embodiment, the flat surface to which the ink leading-out ports 164 are opened is inclined to the gravitational direction when the ink tank is attached to the printing apparatus. For this reason, most of the sedimentary pigment settling on this flat surface move from the flat surface in which the ink leading-out ports 164 are formed to the bottom surface of the ink containing chamber R along the inclined surface. Accordingly, the amount of sedimentary pigment which flows into the ink leading-out ports 164 and the corresponding passages can be reduced.

Figure 13A:
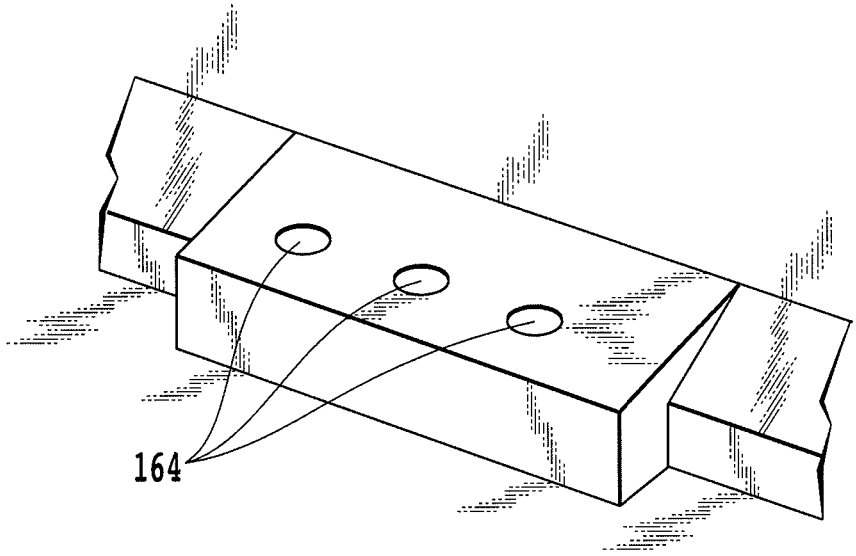
FIG. 13A is a schematic, perspective view showing an ink leading-out port and its vicinity in an ink tank according to an example in comparison to the second embodiment.
Figure 13B:
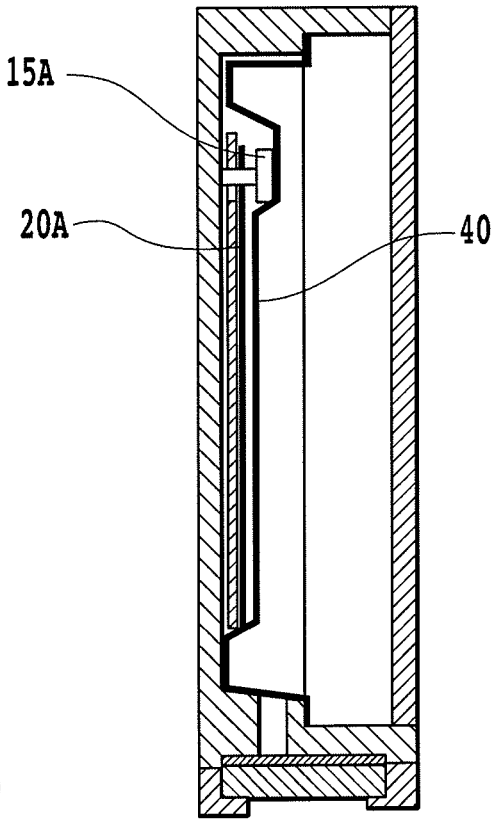
FIG. 13B is a schematic, cross-sectional view used to explain a condition where the ink in the ink tank of the comparative example is almost completely used up.

Additionally, in this example, the convex-shaped bumps 18 raised above the ink leading-out ports 164 are provided on the flat surface (inclined surface) in which the ink leading-out ports 164 are formed. If no bump 18 is provided as shown in FIG. 13A, the ink leading-out ports 164 would be closed by the flexible member 40 as shown in FIG. 13B once the flat surface becomes in parallel with a flat surface of the flexible member 40 formed when ink is running out of the ink tank. In other words, the amount of usable ink contained in the ink containing chamber R may be unstable, and the use efficiency may become lower than expected in some cases. Furthermore, no ink may be led out due to such closure, and no ink may be ejected during the printing operation.

Figure 12:
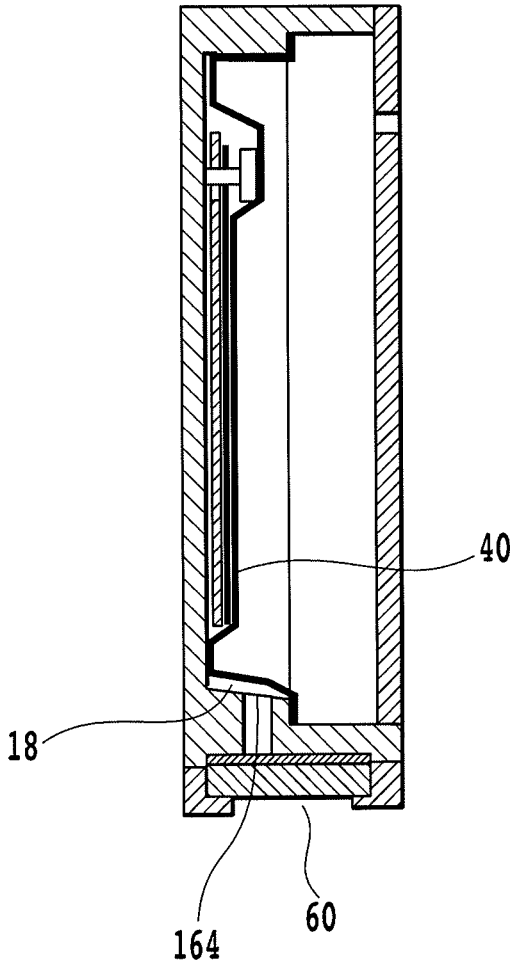
FIG. 12 is a schematic, cross-sectional view used to explain a condition where ink in an ink containing chamber is almost used up in an ink tank according to a second embodiment.

On the contrary, in this embodiment, the convex-shaped bumps 18 located above the ink leading-out ports 164 forms certain gap between the flexible member 40 and the ink leading-out ports 164 as shown in FIG. 12, even when the flexible member 40 is displaced to the maximum and is seated above the ink leading-out ports 164. In other words, the ink leading-out ports 164 are not closed by the flexible member 40.

As described above, the ink tank according to this embodiment is capable of preventing the occurrence of troubles such as the formation of an image with an uneven density and no ink ejection due to a sedimentary pigment. Moreover, the ink tank is capable of stably supplying the ink to a last ink droplet.

Note that the number of ink leading-out ports 164 is not limited to the numbers shown in the drawings. A necessary number of ink leading-out ports 164 may be provided depending on a required flow rate of the ink and the pressure loss of each passage.

The bumps 18 are effective in the case where the ink leading-out ports 164 are possibly closed due to the relationship between the flat surface in which the ink leading-out ports 164 are formed and the flat surface of the flexible member 40 formed when ink is running out of the ink tank. For this reason, it is only necessary for the bumps 18 to have a height different from the height of the surface in which the ink leading-out ports 164 are formed. Moreover, similar effects can be obtained by, for instance, forming a concave grooves instead of the bumps 18. This concave grooves extend from an inner wall 10A along the flat surface in such a way as to penetrate the respective ink leading-out ports 164 as shown by dashed-dotted lines in FIG. 11B. Otherwise, such concave grooves and the convex-shaped bumps may used in combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-221913, filed Aug. 29, 2008, which is hereby incorporated by reference herein in its entirety.

What is claimed is:

1. An ink tank comprising:

an ink containing chamber for containing ink;

an ink supply port for supplying the ink to an outside of the ink tank, and at least one ink leading-out port which opens at a surface provided in an inside of the ink containing chamber, the ink being led out of the ink containing chamber through the ink leading-out port and the ink supply port;

a flexible member for changing a volume of the ink containing chamber by being displaced or deformed as the ink is led out; and a plurality of convex bumps provided on the surface, the plurality of convex bumps being higher than the surface and being spaced apart from the ink leading-out port on the surface.

2. An ink tank as claimed in claim 1, wherein, when the ink tank is placed in a predetermined posture for use, the surface is located higher than a lowermost portion of the ink containing chamber, and the surface is inclined.

3. An ink tank as claimed in claim 1, further comprising an agitating member for agitating the ink in the ink containing chamber.

4. An ink tank as claimed in claim 1, wherein the ink contains a pigment component.

5. An ink tank as claimed in claim 1, wherein a plurality of the ink leading-out ports are provided, each of the plurality of ink leading-out ports opening at the surface.

6. An ink tank as claimed in claim 1, wherein, when the ink tank is placed in a predetermined posture for use, the ink leading-out port opens upwardly.

7. An ink tank as claimed in claim 1, wherein the convex bumps are located above the ink leading-out port.

8. An ink tank as claimed in claim 1, wherein as the ink is led out of the ink containing chamber, the flexible member is displaceable or deformable to a maximum position where the flexible member is seated above the ink leading-out port, and wherein in the maximum position the convex bumps form a gap between the flexible member and the ink leading-out port.

9. An ink tank as claimed in claim 1, wherein the convex bumps have a stepped shape.

* * * * *